US010330306B2

(12) United States Patent
Dyck

(10) Patent No.: US 10,330,306 B2
(45) Date of Patent: Jun. 25, 2019

(54) UNDERWATER LIGHT

(71) Applicant: Artistic Landscaping Inc., Waterloo (CA)

(72) Inventor: Patrick C. Dyck, Waterloo (CA)

(73) Assignee: Artistic Landscaping Inc, Waterloo, Ontario (CA)

( * ) Notice: Subject to any disclaimer, the term of this patent is extended or adjusted under 35 U.S.C. 154(b) by 0 days.

(21) Appl. No.: 15/435,866

(22) Filed: Feb. 17, 2017

(65) Prior Publication Data

US 2018/0238533 A1 Aug. 23, 2018

(51) Int. Cl.

| | |
|---|---|
| ***F21V 33/00*** | (2006.01) |
| ***F21V 31/00*** | (2006.01) |
| ***E04H 4/14*** | (2006.01) |
| *F21Y 113/13* | (2016.01) |
| *F21Y 115/10* | (2016.01) |
| *F21V 3/06* | (2018.01) |
| *F21V 5/04* | (2006.01) |
| *F21V 23/00* | (2015.01) |
| *F21V 23/02* | (2006.01) |
| *H05B 37/02* | (2006.01) |
| *F21S 8/00* | (2006.01) |
| *F21S 9/02* | (2006.01) |
| *F21V 5/02* | (2006.01) |
| *F21V 21/02* | (2006.01) |
| *F21W 131/401* | (2006.01) |
| *F21V 23/04* | (2006.01) |

(52) U.S. Cl.

CPC ..... *F21V 31/005* (2013.01); *E04H 4/148* (2013.01); *F21S 8/033* (2013.01); *F21S 9/02* (2013.01); *F21V 3/062* (2018.02); *F21V 5/02* (2013.01); *F21V 5/045* (2013.01); *F21V 21/02* (2013.01); *F21V 23/005* (2013.01); *F21V 23/02* (2013.01); *F21V 23/045* (2013.01); *F21W 2131/401* (2013.01); *F21Y 2113/13* (2016.08); *F21Y 2115/10* (2016.08); *H05B 37/0272* (2013.01)

(58) Field of Classification Search

CPC ..... E04H 4/148; F21V 3/062; F21V 5/045; F21V 23/005; F21V 23/02; F21V 31/00; F21V 31/005; H05B 37/0245; H05B 37/0272

USPC ..... 362/101

See application file for complete search history.

(56) References Cited

U.S. PATENT DOCUMENTS 6,184,628 B1 2/2001 Ruthenberg
6,315,424 B1 * 11/2001 Hui ..... F21S 8/00 362/101

(Continued)

*Primary Examiner* — Jason M Han
(74) *Attorney, Agent, or Firm* — Bereskin & Parr LLP

(57) ABSTRACT

Provided is a system, method, and an apparatus for underwater lighting. The underwater lighting assembly includes a mounting plate for attaching to an underwater surface of a container for holding a body of water, at least one light source for providing light, a controller electrically connected to the at least one light source, the controller being configured to control the at least one light source, a housing for providing a watertight seal to enclose the at least one light source and the controller, the housing being attachable to the mounting plate, and a signal wire for receiving remote control signals, the signal wire being electrically connected to the controller and configured to extend from the controller to an area outside of the body of water.

15 Claims, 13 Drawing Sheets

(56) References Cited

U.S. PATENT DOCUMENTS

| | | | | |
|---|---|---|---|---|
| 6,936,978 | B2 * | 8/2005 | Morgan | G01R 15/08<br>315/291 |
| 7,410,268 | B2 | 8/2008 | Koren et al. | |

* cited by examiner

UNDERWATER LIGHT

TECHNICAL FIELD

The embodiments disclosed herein relate to under water lighting, and, in particular to systems, methods, and apparatus for underwater lighting.

INTRODUCTION

Water within a swimming pool may be illuminated by an incandescent light that is housed within a watertight fixture that is situated within a cavity in one end of a pool wall, or a niche in a wall of the pool, below a waterline. The cavity, or niche, is required in the wall of the pool because the incandescent light has a longitudinal length wherein the niche is needed to place the bulb so that it does not extend into the pool. The watertight fixture has an outer lens that may protrude slightly into the pool. When a new bulb is needed, the whole fixture is removed from the cavity. A power cable supplying electricity to the light is long enough for the fixture to be safely positioned out of the pool water.

Typically, a clear incandescent light bulb is placed in the fixture. If a colored effect is desired, such as blue, red, or green, then a different color bulb is placed in the fixture. In another embodiment, the outer lens is replaced with a colored lens, or a colored lens cover fits over the clear lens. However, in each of these situations, an individual has to manually make a modification to the pool light to produce a desired color. If the individual wanted to continuously vary the colors where the intensity of the light is not lessened, such an option is not available.

Standard electrical wiring connects the watertight fixture to a 110-voltage source. Nonetheless, providing a 110-volt electricity source to such fixtures presents an element of risk that many would prefer to avoid. Also, such incandescent lamp fixtures frequently expose the imperfections in the interior surface of the swimming pool as a consequence of the lamps diffusion of light and the intensity of the light source.

Light emitting diode (LED) lighting assemblies for swimming pools are frequently designed specifically for above-ground pools and hot tubs. Typically, such assemblies will employ a combination of red, green and blue LED arrays, which permits the generation of up to 256,000 colors.

For example, U.S. Pat. No. 6,184,628 ("the '628 patent") appears to teach the use of predetermined arrays of a plurality of different colored LED bulbs to replace an incandescent pool light where the plurality of different colored LED bulbs are wired in such a manner that the predetermined arrays of plurality of different colored LED bulbs activate at predetermined sequences for predetermined time intervals wherein the bulbs are encased in a lens. Even though LED bulbs are used, providing LED lighting fixtures with brightness to rival incandescent bulbs is still an issue, especially when not all of the LED bulbs are illuminated.

U.S. Pat. No. 7,410,268 describes a control circuit having a hard wired switch which when activated a defined number of times produces a plurality of light colors and/or light patterns wherein each of the plurality of light colors and/or light patterns are selected based on the defined number of times the switch is activated.

It may be desirable to remotely and wirelessly control the light without signal interference from the water. Accordingly, it may be desirable to provide an improved underwater light

SUMMARY

According to some embodiments, there is an underwater lighting assembly comprising a mounting plate for attaching to an underwater surface of a container for holding a body of water, at least one light source for providing light, a controller electrically connected to the at least one light source, the controller being configured to control the at least one light source, a housing for providing a watertight seal to enclose the at least one light source and the controller, the housing being attachable to the mounting plate, and a signal wire for receiving remote control signals, the signal wire being electrically connected to the controller and configured to extend from the controller to an area outside of the body of water.

The underwater lighting may further include a light plate for supporting the light source, wherein the light source is spaced from the light plate.

The underwater lighting may further include a controller board mounted to the housing, wherein the controller is mounted to the controller board.

The underwater lighting may further include an encapsulating layer for encapsulation light plate and the controller board.

The light plate may be spaced apart by a distance D from the controller board, wherein the distance D is selected to provide heat dissipation through the encapsulating layer between the light plate and the controller board. The distance D may be between 0.25 and 0.75 inches.

The at least one light source may be a plurality of light emitting diodes (LEDs). The LEDs may be low power and low voltage. The LEDs may be any one or more of blue, red, or green LEDs.

The underwater lighting may further include an adapter ring for mounting between the mounting plate and the underwater surface.

According to some embodiments, there is a system for underwater lighting including an underwater lighting assembly and a remote control for remotely controlling the controller. The underwater lighting assembly including a mounting plate for attaching to an underwater surface of a container for holding a body of water, at least one light source for providing light, a controller electrically connected to the at least one light source, the controller being configured to control the at least one light source, a housing for providing a watertight seal to enclose the at least one light source and the controller, the housing being attachable to the mounting plate, and a signal wire for receiving remote control signals, the signal wire being electrically connected to the controller and configured to extend from the controller to an area outside of the body of water.

The system may further include a transformer electrically connected to the underwater light assembly and a power source, wherein the transformer reduces voltage and power provided to the underwater lighting assembly.

The remote control may include a plurality of buttons for selecting the lighting of the underwater lights.

According to some embodiments, there is a method for installing underwater lighting. The method includes removing water from a body of water to below a desired mounting water level, drilling an electrical conduit in a surface of the body of water, mounting a mounting plate to the surface of the body of water proximate to the electrical conduit, pulling an electrical cable including a signal wire through the electrical conduit to a junction box, and attaching a underwater lighting assembly to the wall bracket.

The method may further include controlling the underwater light with a remote control.

The method may further include affixing an adapter ring between the mounting plate and the surface off the body of water.

The method may further include wrapping the electrical cable around a rear surface of the underwater lighting assembly.

The method may further include installing a low voltage transformer in the junction box at a distance from an edge of the body of water.

The method may further include securing a junction box cover over the junction box.

The method may further include mounting the mounting plate to the surface of the body of water having a radius of more than 6 feet.

Other aspects and features will become apparent, to those ordinarily skilled in the art, upon review of the following description of some exemplary embodiments.

BRIEF DESCRIPTION OF THE DRAWINGS

The drawings included herewith are for illustrating various examples of articles, methods, and apparatuses of the present specification. In the drawings.

DETAILED DESCRIPTION

Figure 1:
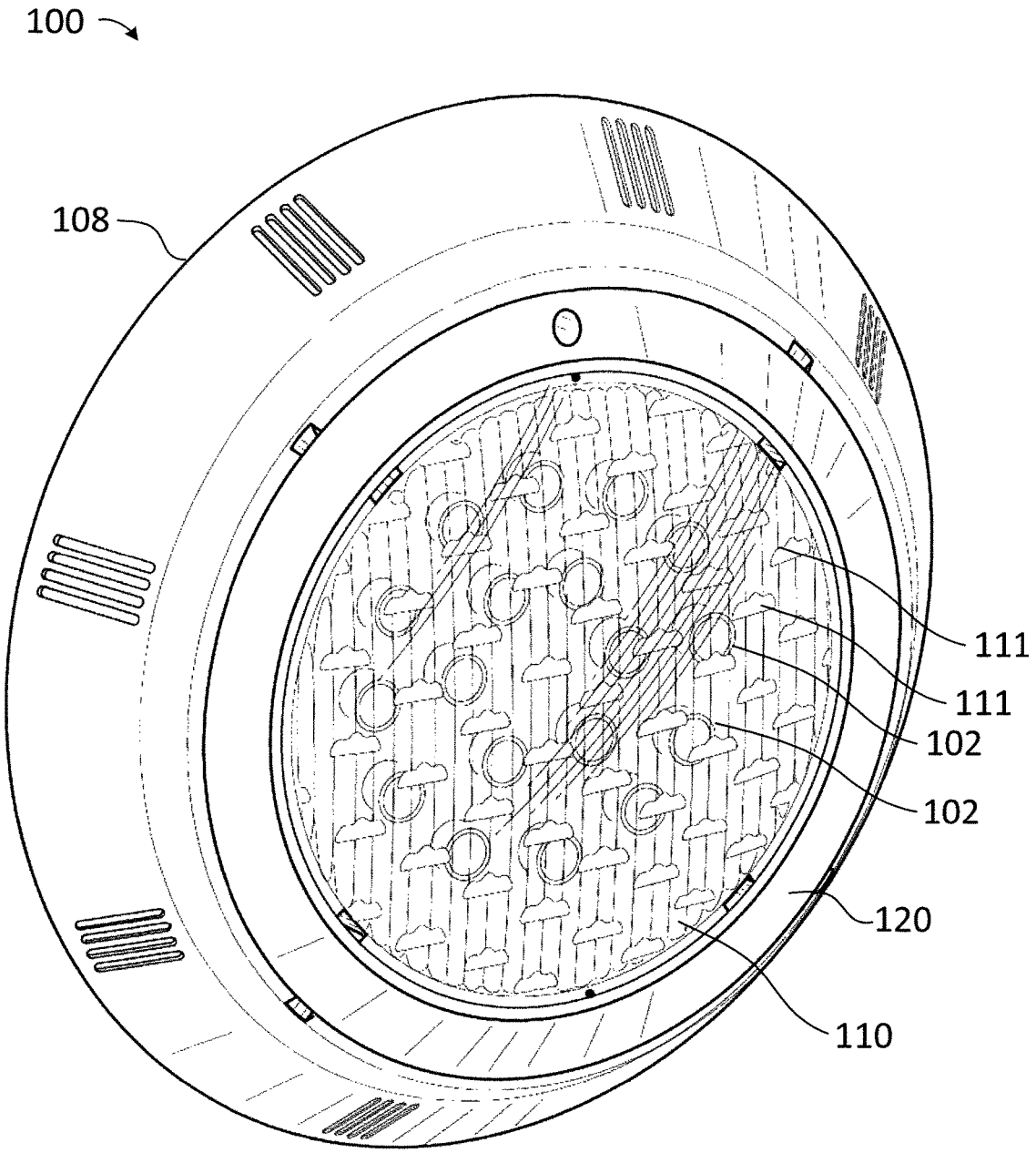
FIG. 1 is a perspective view of an underwater light assembly, in accordance with an embodiment.
Figure 2A:
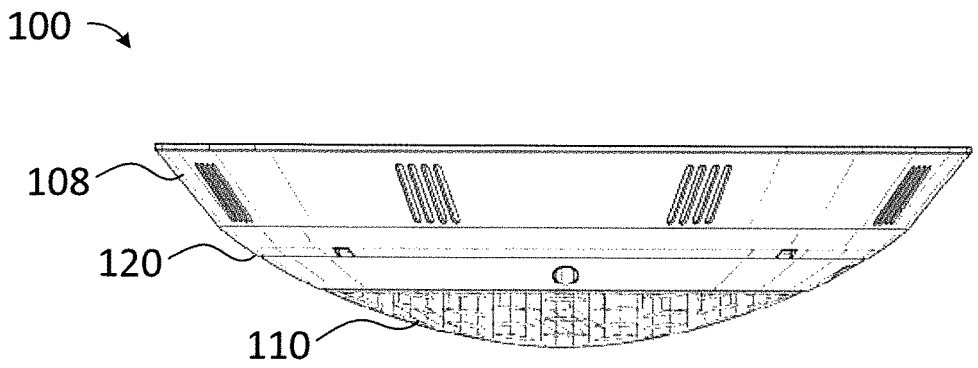
FIG. 2A is a top view of the underwater light assembly of FIG. 1.
Figure 2B:
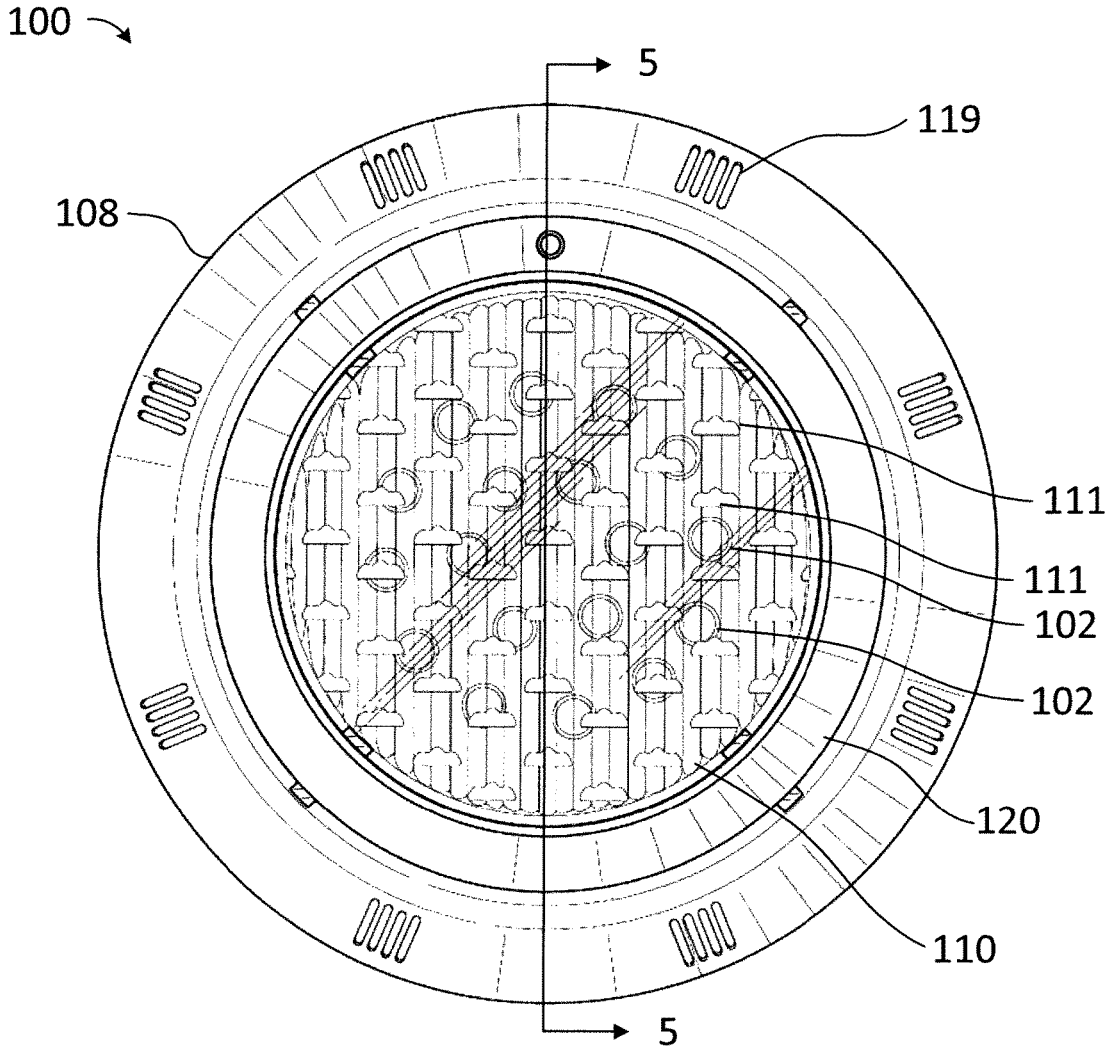
FIG. 2B is a front view of the underwater light assembly of FIG. 1.

Various apparatuses or processes will be described below to provide an example of each claimed embodiment. No embodiment described below limits any claimed embodiment and any claimed embodiment may cover processes or apparatuses that differ from those described below. The claimed embodiments are not limited to apparatuses or processes having all of the features of any one apparatus or process described below or to features common to multiple or all of the apparatuses described below.

Referring to FIGS. 1 to 5, illustrated therein is an underwater light assembly 100, in accordance with an embodiment. The underwater light assembly 100 attaches to an underwater surface of a container for holding a body of water. The container may be natural occurring such as a lake or pond bottom. The container may be man-made such as a concrete pool, a fiberglass pool, or a steel pool with a vinyl liner, or the like. The underwater surface of a body of water such as a wall or floor of a body of water. The underwater light assembly 100 is waterproof and may be immersed in liquid, such as saltwater, chlorinated water, and freshwater. The body of water may be a pool, a pond, a lake, or the like. In particular, the body of water may be a chlorinated or saltwater swimming pool, a freshwater or saltwater water feature, a large freshwater or marine aquarium, an underwater cave, a grotto, or a lagoon, under dock lighting in freshwater saltwater underwater safety lighting for marinas, or underwater shore lighting in freshwater or saltwater.

The underwater light assembly 100 includes at least one light source 102 for providing light. In certain cases, the at least one light source 102 is a plurality of light emitting diodes (LEDs). The LEDs may be of low power and low voltage (e.g., 12 V) and alternating current (54 watts). In the embodiment shown, the underwater light assembly 100 includes 18 LEDs 102 at 3 watts each for a total of 54 watts.

The LEDs may be more energy efficient than regular underwater lights. This LEDs may have improved electrical efficiency (e.g., 75%). The low power and low voltage LEDs may reduce the chance of electric shock. The light sources 102 may provide an angle of dispersion of about 45 degrees so that light is directed through a lens 110 to shine light towards the surface of the water. The light sources 102 may be configured, in contrast to conventional LEDs which usually provide angle of dispersion of 10 to 15 degrees.

The light sources 102 may provide different colors. For example the light sources may be any one or more of blue, red, or green LEDs. The light sources 102, in combination, may be triggered to provide any of purple, aqua, yellow, and white. The light sources 102 may also provide a variety of different color combinations and light show programs.

The underwater light assembly 100 includes a housing 104 for providing a watertight seal to enclose the light sources 102. The housing 104 includes a housing body 106, a housing cover 108, and the lens 110. The housing 104 may be made of corrosion free materials that will not break if bumped during underwater play or if struck by pool toys. The housing 104 may not have any glass components to reduce the possibility of dangerous shards that could cut pond or pool liners. The housing 104 may be made of strong, durable polymer plastics. The housing 104 may include a set of tabs 105 for holding excess cable that is wrapped around the housing 104. The lens 110 may include a ultraviolet protective layer to inhibit the lens 110 from yellowing when the sun penetrates the lens 110.

Figure 5:
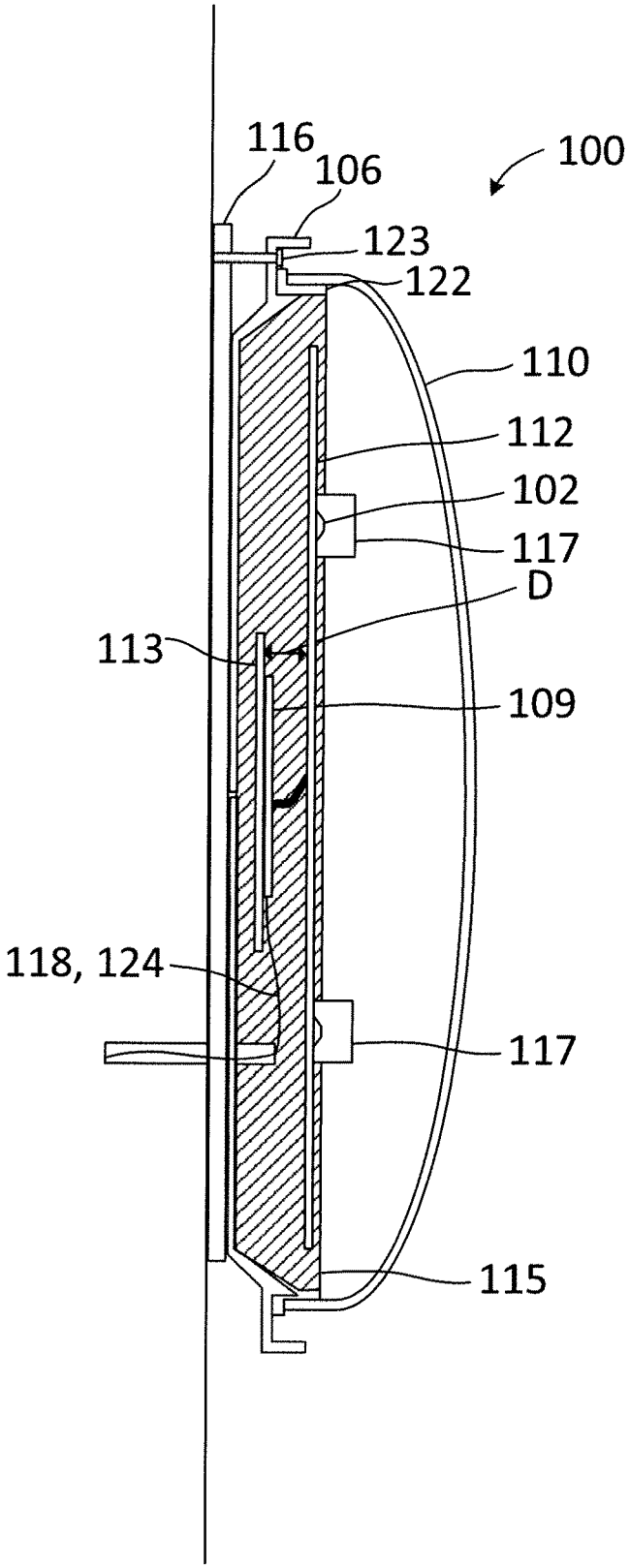
FIG. 5 is a sectional view, with certain components removed for clarity and certain components shown schematically, of the underwater light assembly along 5-5 of FIG. 2B.

The at least one light source 102 attaches to the light plate 112. The light source 102 may be spaced (e.g., ⅜") from the light plate 112, to dissipate heat through the air. Each light source 102 may be encapsulated by an individual lens 117. The light sources 102 are electrically connected to a controller 109 mounted on a controller board 113 (FIG. 5). The controller board 113 is mounted to the housing 106. The controller 109, or control circuitry, controls the at least one light source 102. The controller 109 determines what light sources 102 to trigger on and off and converts electrical signals into light commands. The light plate 112, controller 109, and controller board 113 are encapsulated by an encapsulating layer 115. The encapsulating layer 115 may be a silicone material that is provided to give a water tight seal to the controller 109, the controller board 113, and the light plate 112. The light plate 112 may be spaced apart by a distance D from the controller board 113. The distance D is such that there is heat dissipation through the encapsulating layer 115 between the light plate 112 and the controller board 113. The distance D may be about 0.25 inches to 0.75 inches, and more particularly about 0.5 inches.

The lens 110 may be made of high clarity, shatter resistant polymer plastics. The lens 110 may be made of plastic, such that if a crack is formed, the lens 110 does not break. The lens 110 may include light refracting prisms 111 to optimize lighting effectiveness. The light refracting prisms 111 facilitate light retention in the water to create an optically pleasing ambience.

The underwater light assembly 100 includes a mounting plate 116 for mounting the housing 108 to the underwater surface of the container. The mounting plate 116 may be used for new installations as well as a retrofit for an existing pools. For niche installations, the mounting plate 116 attaches to an optional adapter ring 114, and the adapter ring 114 is mounted to the underwater surface of the container.

The underwater light assembly 100 includes a light plate 112. The light plate 112 attaches the at least one light source 102 to the housing body 106. The light plate 112 is made of a material that supports the light sources 102. The light plate 112 may include conductive elements and pathways to provide electrical conductivity selectively to each of the light sources (see, for example FIG. 11). The light plate 112 is spaced apart from a back surface of the underwater light assembly 100 such that there is a dissipation for any heat created by the light sources 102. The spacing provides spacing such that the light sources 102 do not overheat or cause damage to the underwater light assembly 100, while the light sources 102 are lit.

The underwater light assembly 100 includes a face cover 120 that attaches the lens 110 to the housing cover 108. The face cover 120 may attach the lens 110 to the housing cover, for example using tabs 121 or a snap fitting. The face cover 120 may be removable to provide access to the light sources 102 so that the light sources can be replaced, if burnt out. The housing cover 108 may include slots 119 there through. The slots 119 may provide water circulation and ventilation to prevent buildup of algae and water debris. The housing cover 108 may have smooth edges that are angled to the wall surface such that pool cleaners are able to navigate over the surface of the housing 108.

The underwater light assembly 100 includes a lens seal 122 for sealing the lens 110 to the housing cover 108. The lens seal 122 may provide a substantially watertight seal to the lens and housing cover 108 such that the area inside the lens 110 and adjacent the light sources 102 is sealed off from the exterior of the underwater light assembly 100 particularly when the underwater light assembly 100 is submerged in the body of water. The lens seal 122 may be made from a soft and flexible material that can conform to the surfaces of the lens 110 and the housing cover 108. The lens seal 122 may be compressed and sandwiched between the lens 110 and the housing cover 108 to inhibit the passage of water into the light source 102 compartment. As heat is dissipated from the encapsulating layer 115, the lens seal 122 may be provided with a softer material, as heat expansion may be reduced. The lens seal 122 may be integrally formed with the encapsulating layer 115.

The underwater light assembly 100 includes an electrical cable 124, which at a first end, attaches to electrical terminals 126 of the controller 109 and onto the light sources 102. An opposite, second end of the electrical cable 124 may connect to a power source 128. The power source 128 may be, for example, a removable source of energy, such as a battery, or the power source 128 may be a transformer connecting to the electrical grid. The power source 128 provides power to the light sources 102.

The underwater light assembly 100 includes cable jacket having a signal wire 118 for receiving remote control signals to control the light sources 102. The signal wire 118 is connected to the controller 109 and is configured to pass from the underwater surface of the container to an area outside of the underwater surface, such as a land area on or near the deck surface. The signal wire 118 may pass with the electrical cable 124. The signal wire 118 is electrically connected to the light sources 102 at one end, and passes through the pool deck and to the deck surface. The signal wire 118 communicates with the remote control 154 to communicate activation instructions to the light sources 102. The signal wire 118 may provide improved communication with the remote control, for example, of at least 45 feet from the underwater light assembly 100.

The underwater light assembly 100 includes a sealing o-ring 130 for sealing the electrical cable 124 to the housing body 106. The sealing o-ring 130 may provide for a watertight seal into the housing body 106 such that water is inhibited from entering the underwater light assembly 100. The sealing o-ring 130 passes around an outer surface of the electrical cable 124 and into an aperture of the housing body 106.

Figure 6A:
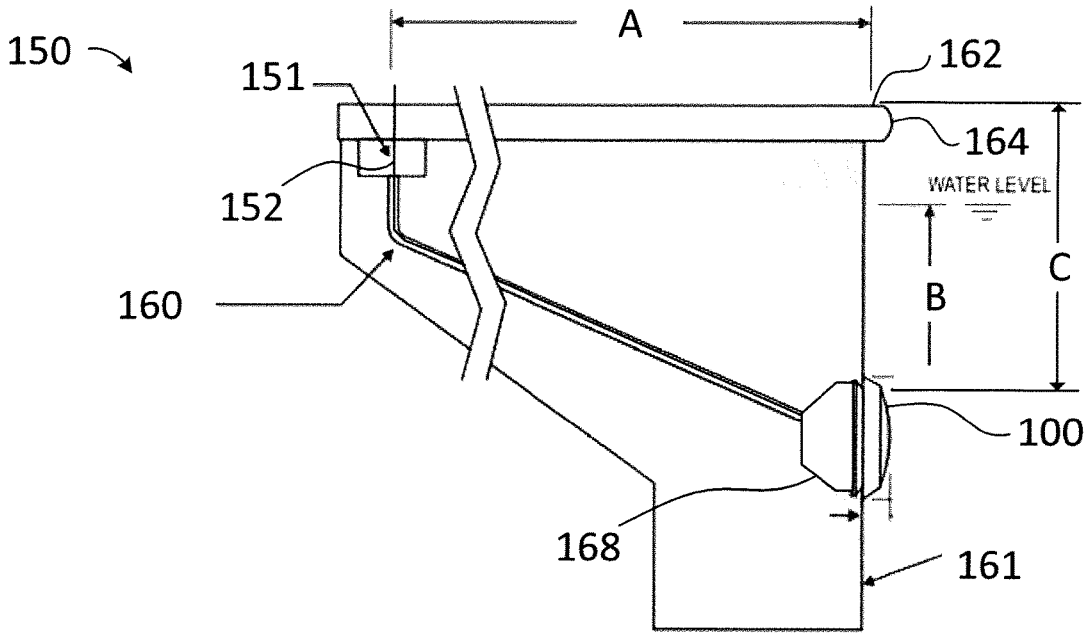
FIGS. 6A and 6B are side installation views of the underwater light assembly of FIG. 1, in a concrete and liner pool.
Figure 6B:
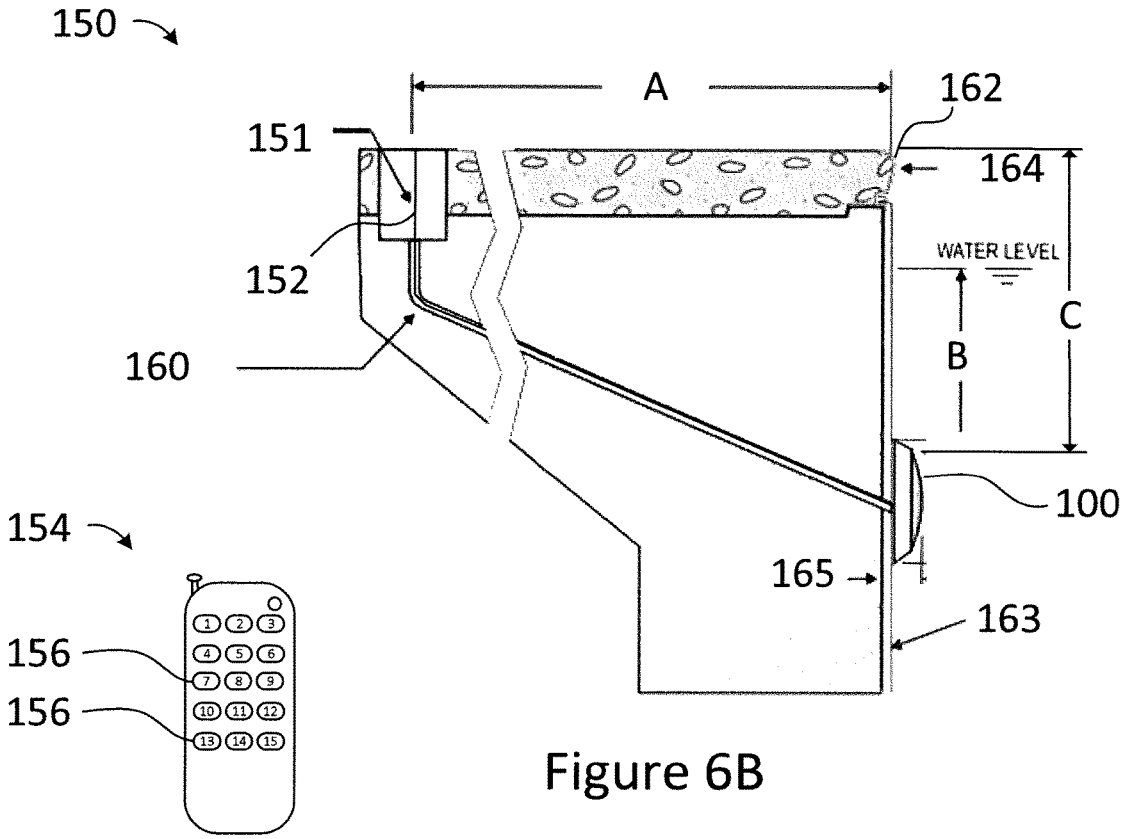

Turning now to FIGS. 6A and 6B, illustrated therein is a system 150 for underwater lighting, in accordance with an embodiment. The system 150 includes a underwater light assembly, for example, the underwater light assembly 100 as described with reference to FIGS. 1 to 5.

The underwater light assembly 100 is electrically connected to a junction box 151. The junction box may be a low voltage transformer connected to a power source that reduces voltage and power (e.g., reducing 110 V to 12 V). The junction box 151 may accommodate one or more light assemblies. The junction box 151 may be positioned at a minimum distance A from the side 161 of the pool and the location of the underwater light assembly 100. In particular, the distance A may be a minimum 120 cm (4 ft.) from edge of pool to reduce the chance of electric shock. Low power components of the light assembly and shock-protected metal parts are within a certain proximity to the pool to reduce electrical shock.

The system 150 includes a signal receiver 152 at the end of the signal wire (118) extending from the underwater light assembly 100 for receiving signals from a remote control 154. The signal wire 118 may pass from the underwater light assembly 100 and through a pool conduit 160 in the side 161 of the pool. The signal receiver 152 may be below a pool deck 162 of the pool deck (as illustrated at FIG. 6A) or at the top surface of the pool deck (as illustrated in FIG. 6B). The signal receiver 152 may connect with the signal wire 118 of the underwater light assembly 100 to provide control instructions to the underwater light assembly 100.

The pool conduit 160 may be a drilled through hole leading from the location of the underwater light assembly 100, through the pool wall surface, and pass at an angle up to the signal receiver 152. In a particular embodiment, for improved signal range, the signal receiver 152 extends above the ground, as illustrated at FIG. 6B.

The underwater light assembly 100 may be provided at a distance B below the surface of the water, and at a distance C below the top 162 of the pool deck 164. The location of the underwater light assembly 100 may be such that the light assembly is submerged below the water level of the pool. The distance B may be greater than 45 cm or 1.5 feet and up to 20 feet. The distance B may be such that the light generated from the light assembly is visible from the surface of the water.

As seen from FIG. 6A, the underwater light assembly 100 may be affixed directly to the wall 161 of the pool. As seen from FIG. 6B, the underwater light assembly 100 may be affixed over a pool liner 163 and a pool panel 165. Where the underwater light assembly 100 is affixed directly to the pool wall 161 of the pool, the wall of the pool may include a recess 168. The recess 168 provides a location for some of the components of the underwater light assembly 100 such as the electrical cable 124. The recess 168 may be cut back around the underwater light assembly 100 to allow for a compact seal.

The system 150 includes the remote control 154 for remotely controlling the power provided to the light sources 102. The remote control 154 communicates with the signal receiver 152 located at the surface of the pool deck 162. Advantageously, the remote control 154 need not communicate through water, as water may distort or disrupt certain control frequencies.

Where the underwater light assembly 100 includes light sources that may have different colors, the remote control controls the color of the illuminated light sources 102. The remote control 154 includes a plurality of buttons 156 for selecting various lighting options for the lighting of the light source 102. For example, the remote control 154 may include different settings to select colors and color cycle modes. The remote control 154 may be a purpose built device or may be, for example, a mobile device such as a smart phone, with a variety of functions.

The remote control 154 may include buttons 156 for any one or more of activation, on, off, or a particular color or a particular sequence of colours. In an embodiment, the underwater light assembly 100 is operable to produce a plurality of individual colors, including any one or more of blue, red, green, purple, aqua, yellow, and white, that are selected using the remote control 154. The underwater light assembly 100 may be operable to perform a plurality of different color cycles, including, for example, any one or more of red-yellow-green, green-aqua-blue, red-purple-blue, red-green-blue, green-purple-blue-red-white-aqua-yellow, or a gradual change of all colors. In some cases, the user may be able to program a particular desired color sequence into the underwater light assembly 100.

In certain embodiments, the underwater light assembly 100 may include a memory on the controller board (113) that will save the color cycle mode that was last set. When the underwater light assembly 100 is turned back on, the color cycle mode that was last set will be initiated.

Figure 7A:
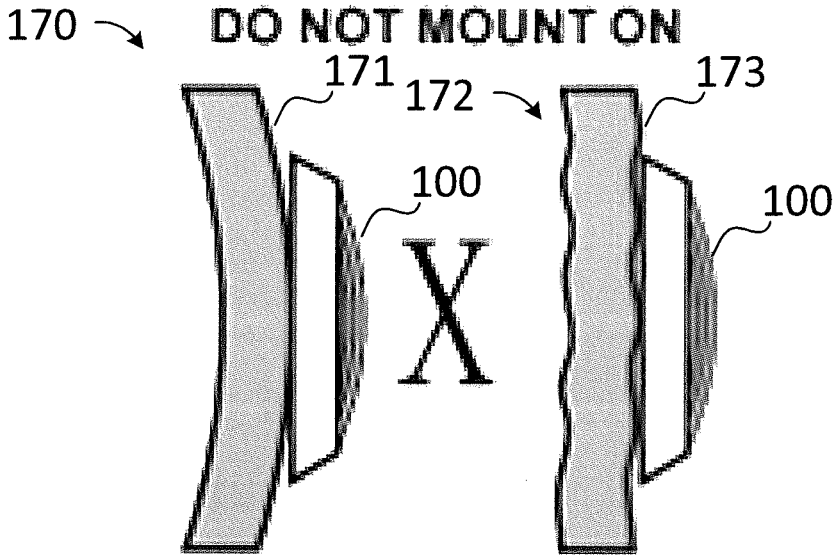
FIG. 7A is a top view of a mounted underwater light assembly, in accordance with an embodiment.
Figure 7A:
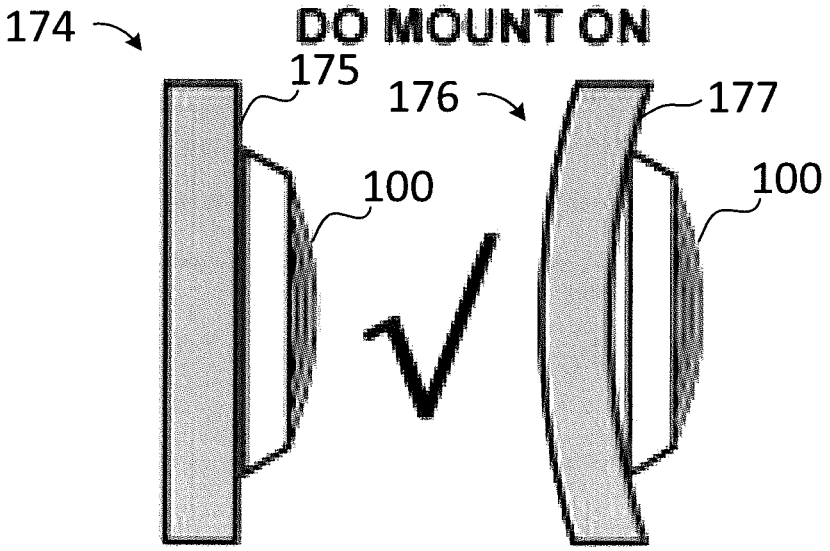

Turning now to FIG. 7A, illustrated therein are mounting examples 170, 172, 174, 176, in accordance with an embodiment.

At 170, the underwater light assembly 100 may not be mounted to walls having a reverse radius surface 171. At 172, the underwater light assembly 100 may not be mounted to walls having a particularly uneven surface 173. The underwater light assembly 100 may not be mountable to these surfaces 171, 173, or may be more easily damaged when the underwater light assembly 100 is struck.

The underwater light assembly 100 may be mounted to a wall having a flat surface 175, or a wall surface 177 with a radius of no less than 6 feet as viewed from the pool surface. The underwater light assembly 100 may be mounted to these surfaces 175, 177 to provide a stable and watertight surface between the underwater light assembly 100 and the wall surface 175, 177.

Figure 7B:
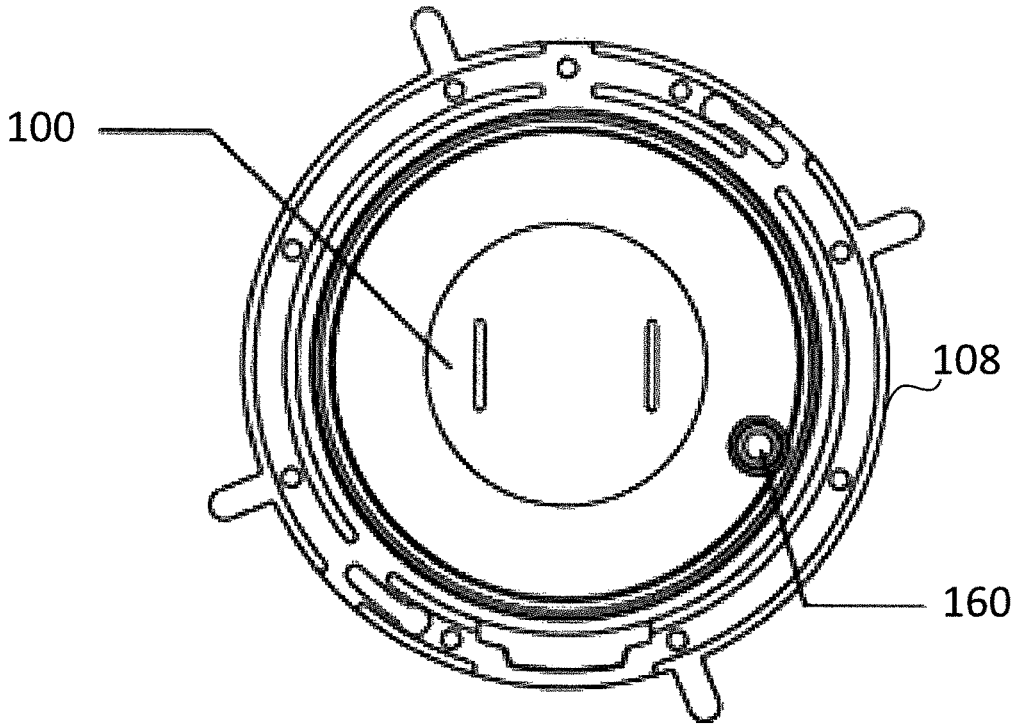
FIG. 7B is a rear view of the underwater light assembly of FIG. 1.
Figure 7C:
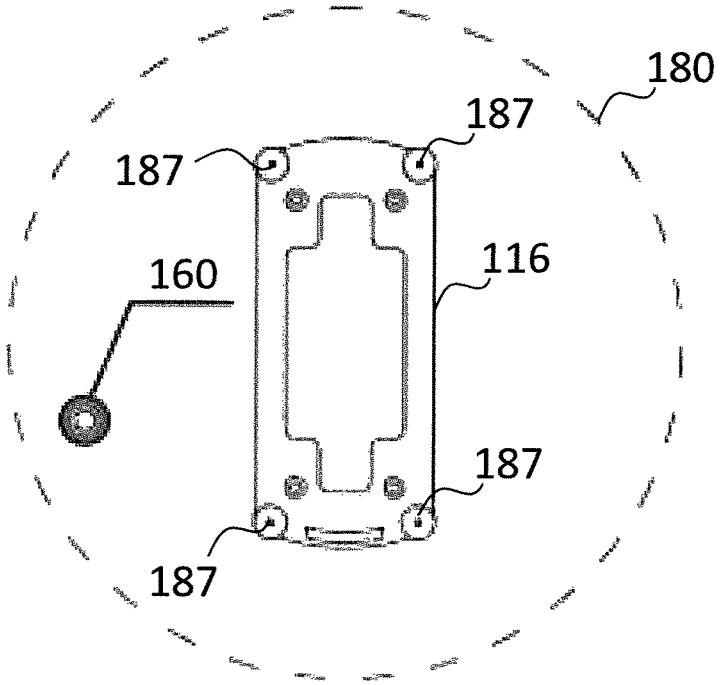
FIG. 7C is a rear view of a mounting plate, of the underwater light assembly of FIG. 1.

FIG. 7B illustrates the location of the pool conduit 160 with respect to the back of the underwater light assembly 100 (where the adapter ring 114 is not used). The pool conduit 160 is located proximal and adjacent the back of the underwater light assembly 100 and within the radius of the housing cover 108. FIG. 7C illustrates a wall view of the location of the pool conduit 160 and relative to the housing cover 108. The mounting plate 116 (shown schematically) is mounted directly to the wall. The pool conduit 160 is located to ensure that the underwater light assembly 100 will cover the pool conduit 160 and be within the radius 180 of the adapter ring 114. The mounting plate 116 is mounted directly to the wall with fasteners passing through wall-mount apertures 187 and into the wall. The wall-mount apertures 187 may include a grommet for providing a watertight seal.

Figure 7D:
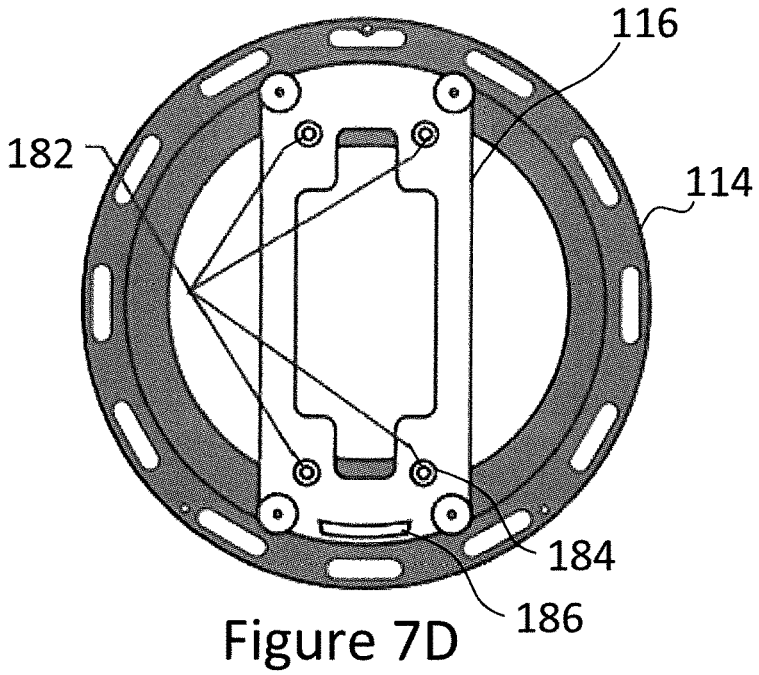
FIG. 7D is a front view of a mounting plate and an adapter ring of the underwater light assembly of FIG. 1.

FIG. 7D illustrates the adapter ring 114 for niche installations (e.g., FIG. 6A) where there is a recess in the pool wall. The mounting plate 116 is fastened to the adapter ring 114. In particular the mounting plate 116 is mounted to the back plate via fasteners 182 and through mounting apertures 184 in the mounting plate 116. For example the fasteners 182 may be screws or bolts or the like.

Figure 7E:
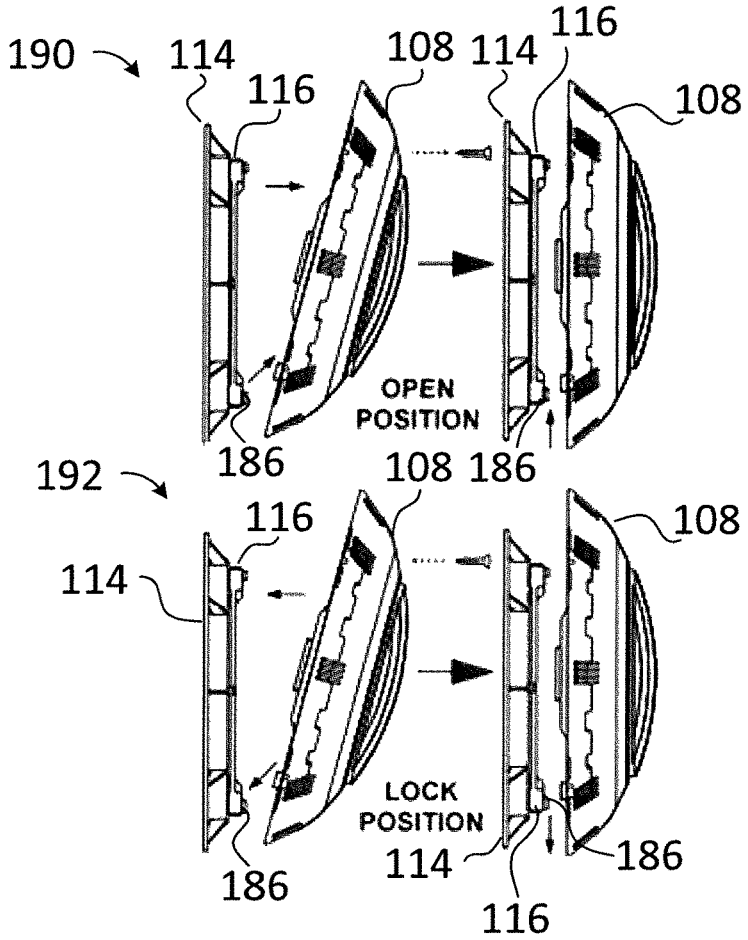
FIG. 7E is a side view of an installation of the underwater light assembly of FIG. 1.

FIG. 7E illustrates the attachment of the light assembly housing to the mounting plate. In an open position, at 190, the mounting screw is removed and the housing tab is lifted up and out 186 of the slot in the mounting plate that is attached to the adapter ring 114, in an outward and upward motion. In a lock position, at 192, the housing body 108 is inserted into the slot in the mounting plate 186 that is attached to the adapter ring 114, in an inward and downward motion.

Figure 8A:
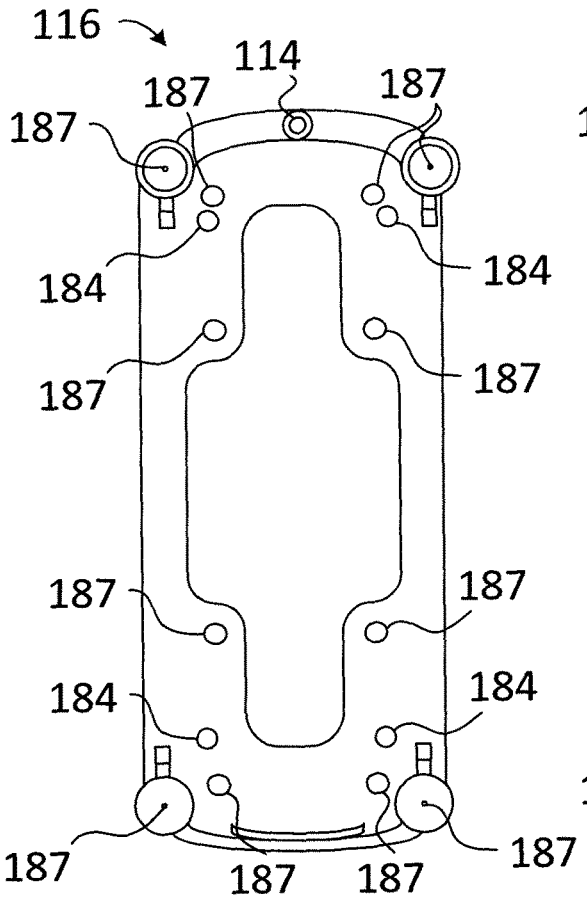
FIGS. 8A and 8B are front and rear views, respectively, of a mounting plate of the underwater light assembly of FIG. 1.
Figure 8B:
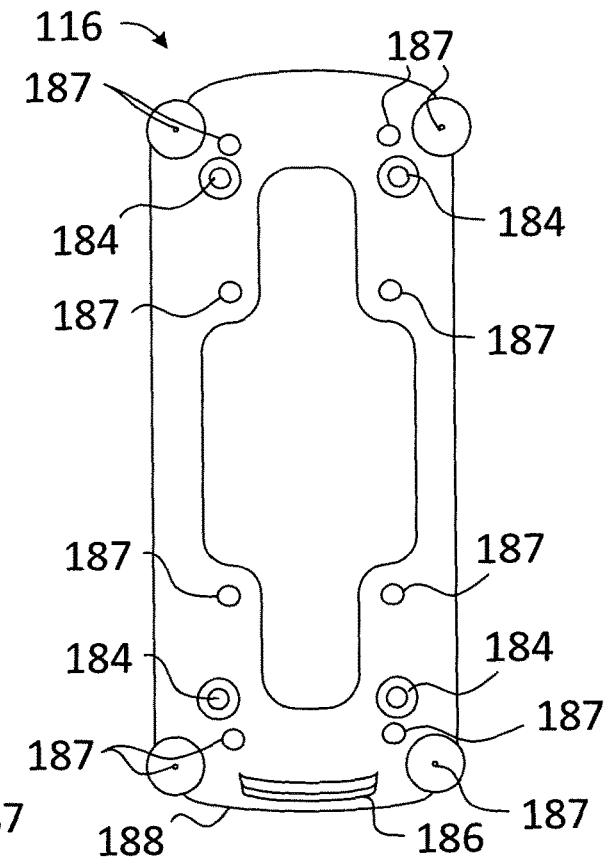

FIGS. 8A and 8B illustrate a front and rear view, respectively, of the mounting plate 116, in accordance with an embodiment. The mounting plate 116 includes mounting apertures 184 for fastening, with fasteners 182 (FIG. 7D), to the adapter ring 114. (FIG. 7D) The mounting plate 116 includes wall-mount apertures 187 for attaching directly to the wall, for where no adapter ring 114 is used. The mounting plate 116 may be a universal bracket having a plurality of mounting holes 187 to be selected to mount to a particular set of pre-existing mounting holes in the wall.

The mounting plate 116 include the housing slot 186 positioned at a bottom end 188 of the mounting plate 116. As seen from FIG. 4, the housing body 100 includes a mounting tab 199 for mating with the housing slot 186 (FIG. 8B) of the mounting plate 116. Once the mounting tab 199 is inserted into the mounting plate slot 186 of the mounting plate 116 the housing 106 is attached to the mounting plate with a fastener 123.

Figure 8C:
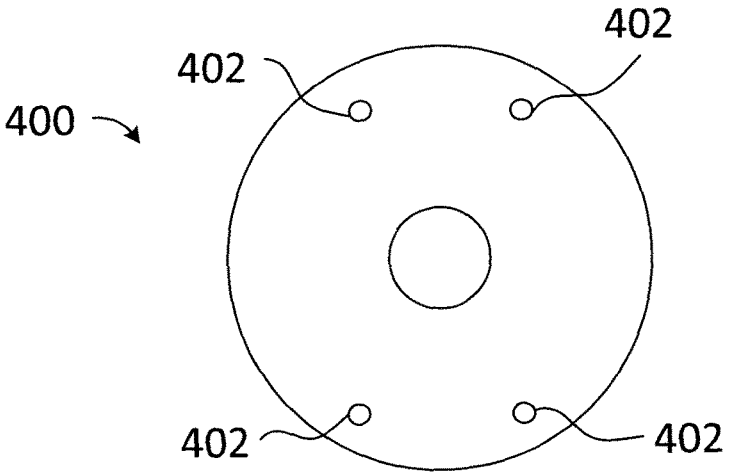
FIG. 8C is a front view of a mounting washer, in accordance with an embodiment.

FIG. 8C illustrates a mounting washer 400, in accordance with an embodiment. The mounting washer 400 mates between the mounting plate 116 and the adapter ring 114 for particular retrofit mounting applications. The mounting washer 400 provides additional thickness (e.g., ⅛" thick) to fit certain conventional fittings. The mounting washer 400 has a plurality of apertures 402 that correspond to the mating holes 187 of the mounting plate 116.

Figure 9A:
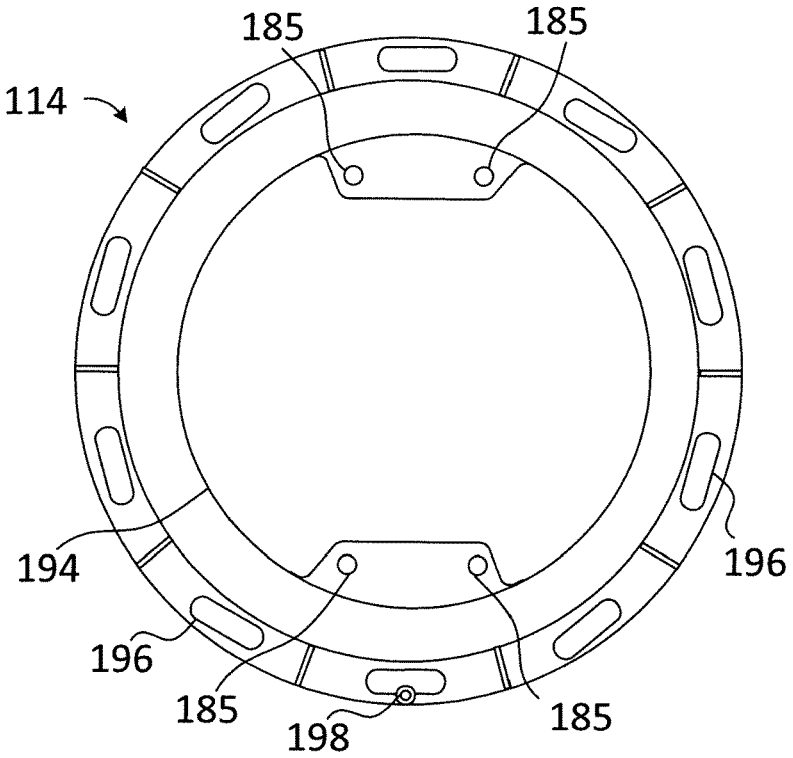
FIGS. 9A and 9B are front and rear views, respectively, of an adapter ring of the underwater light assembly of FIG. 1.
Figure 9B:
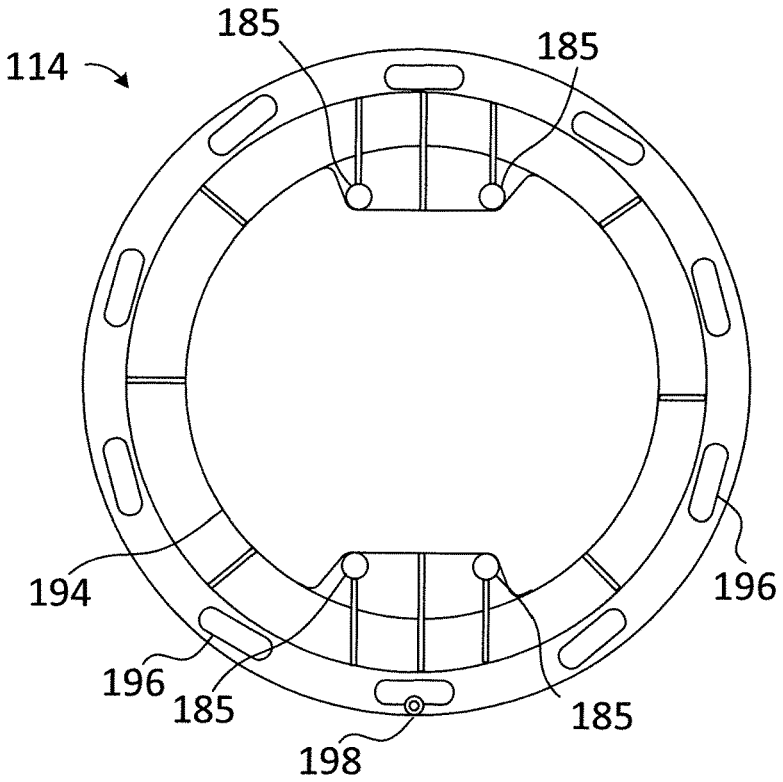

FIGS. 9A and 9B illustrate a front and rear view, respectively, of the adapter ring 114, in accordance with an embodiment. The adapter ring 114 includes mounting apertures 185 for receiving fasteners 182 (FIG. 7D) to attach to the mounting plate 116. The adapter ring 114 includes a cutout 194 for the signal wire 118 to pass through. The adapter ring 114 also includes a plurality of wall mounting apertures 196 (e.g., slots) for providing attachment to existing light features. The adapter ring 114 also includes a securing aperture 198 for receiving a fastener to fasten the housing body 106 securely to the adapter ring 114. The adapter ring 114 has a depth to space the underwater light assembly 100 a distance from the pool wall.

Figure 10:
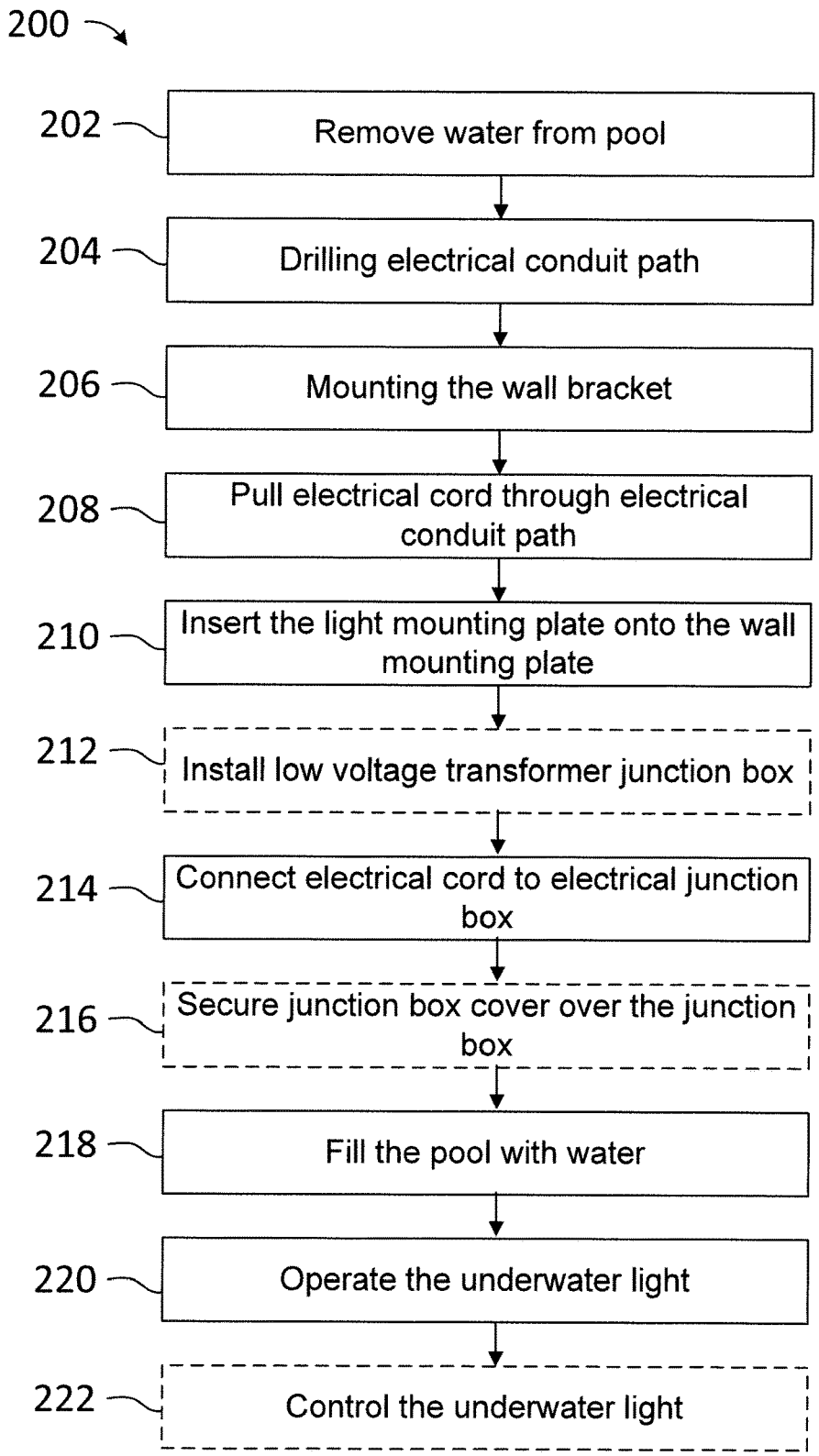
FIG. 10 is a flow chart of a method for installing an underwater light assembly, in accordance with an embodiment.

Turning now to FIG. 10, illustrated therein is a method 200 for installing underwater lighting, in accordance with an embodiment. The method 200 may be performed by a qualified electrician to ensure that the electrical system and wiring conform to local electrical codes.

At 202, water is removed from the pool or body of water to below the desired mounting location between 1.5 and 20 feet. At 204, an electrical conduit path is drilled in a surface of the pool. The electrical conduit path is for the electrical cord which provides power to the light assembly and includes a signal wire for controlling the light assembly.

At 206, the adapter ring is mounted to the surface of the pool proximate to the electrical conduit path. The wall bracket may not be mounted to a wall with radius of less than 6 feet (as described with reference to FIG. 7A). The mounting bracket is installed to ensure that the top edge of the light lens may be a minimum of 45 cm (1.5 ft.) below the water surface. The electrical conduit may be located 2.5" to the left and 1" below the center position of where light is to be installed.

Where the pool is a liner pool, a drill hole is drilled in the pool panel to the size of the electrical cord and the conduit is installed to protrude through pool panel. Excess electrical conduit may be trimmed after backfilling and prior to liner installation. Once backfilling is complete, prior to liner installation, the conduit is trimmed to be about flush with pool panel.

At 208, the electrical cord including the signal wire is passed through the electrical conduit path to the junction box. At 210 the mounting plate is affixed to the adapter ring.

For non-niche mounting, the mounting plate is mounted directly to the pool and the light housing covers the conduit hole. The back of the mounting plate is flush with the surface of the finished pool wall. For plastered pools, concrete cutback is provided for plaster thickness. For finished concrete, the surface is flush with the front surface of the mounting plate. Once the pool surface is finished, the electrical cord is inserted into the conduit hole and the electrical cord is pulled through to the junction box. Slack electrical cord may be provided at the light assembly for servicing.

Figure 3:
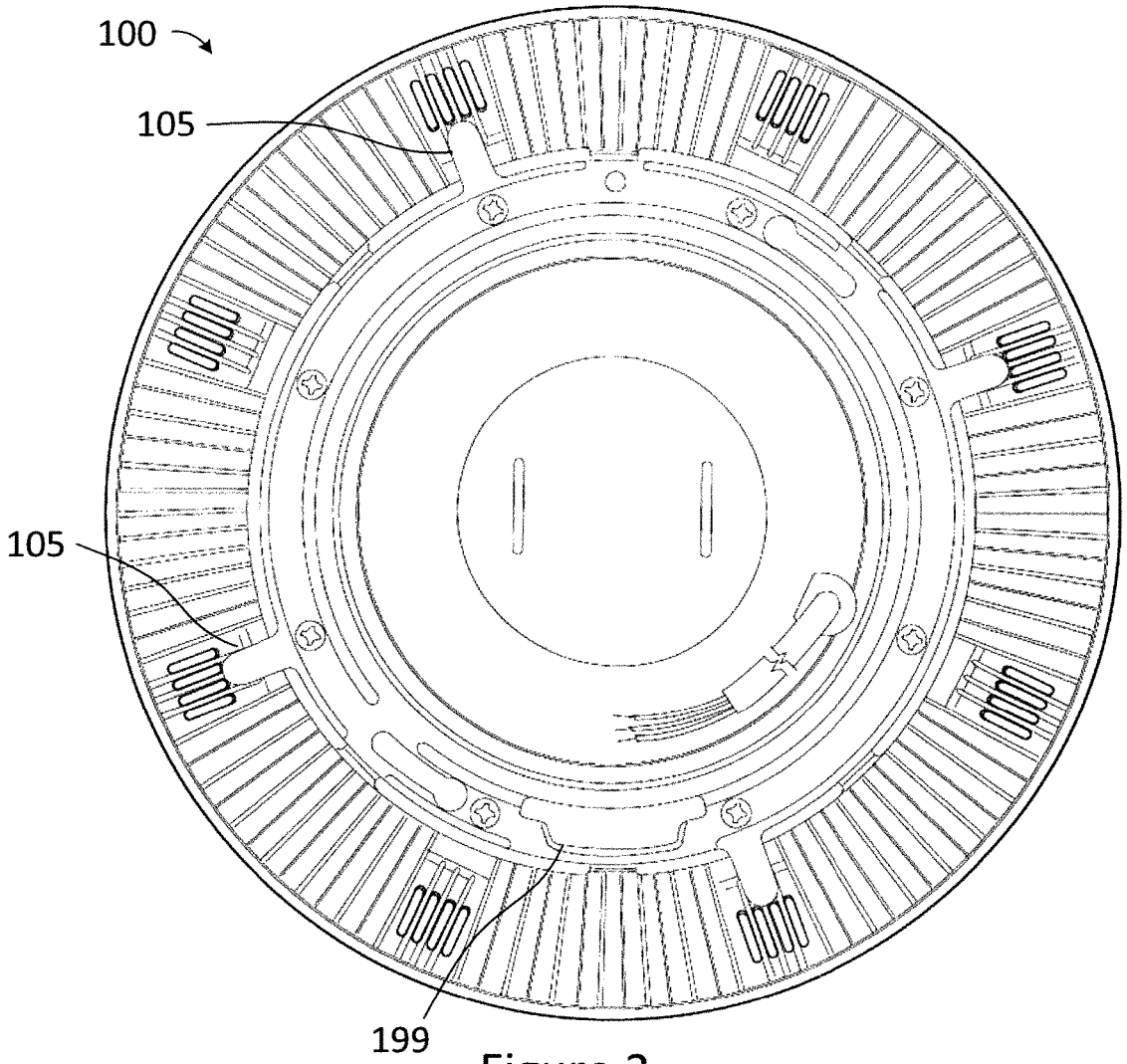
FIG. 3 is a rear view of the underwater light assembly of FIG. 1.
Figure 4:
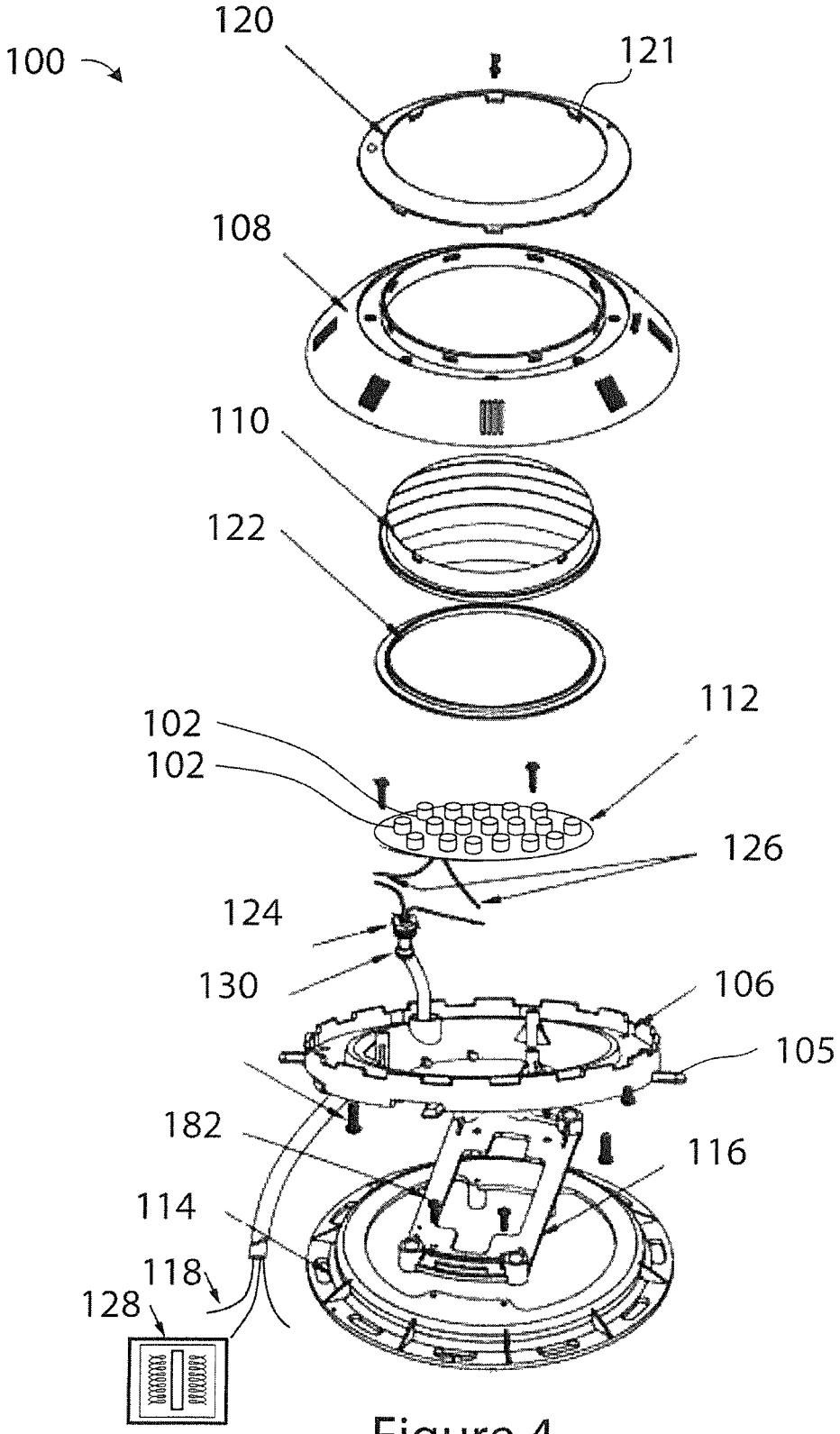
FIG. 4 is an exploded view of the underwater light assembly of FIG. 1.

A length of the electrical cord may be wrapped around the back of the light assembly, and held by tabs 105 (shown at FIGS. 3 and 4). This extra length (e.g., to a maximum of 2.4 m (8 ft.) long) allows for the light to be brought out of the pool for re-lamping and servicing. For liner pools, waterproof silicon may be applied around the electrical cord at the liner to seal the electrical cord to the pool liner.

Optionally, for niche installations, the adapter ring is used. The adapter ring is fastened to the wall (existing niche) through the slots. The mounting plate is then mounted to the adapter ring.

The ring tab near the inside bottom of light is inserted into slot in bottom of mounting plate. The housing is fastened to the mounting plate for example, with a screw passing through a hole in the top of the mounting plate where the light assembly is in a vertical position to slip the tab into the slot.

At 212, the low voltage transformer junction box is optionally installed at a distance from the edge of the pool. At 214, the electrical cord is connected to the junction box. At 216, a junction box cover is secured over the junction box. At 218, the pool is filled with water until the underwater light is submerged before the light is operated. The light is operated at 220. At 222, the underwater light is controlled with the remote control.

Figure 11:
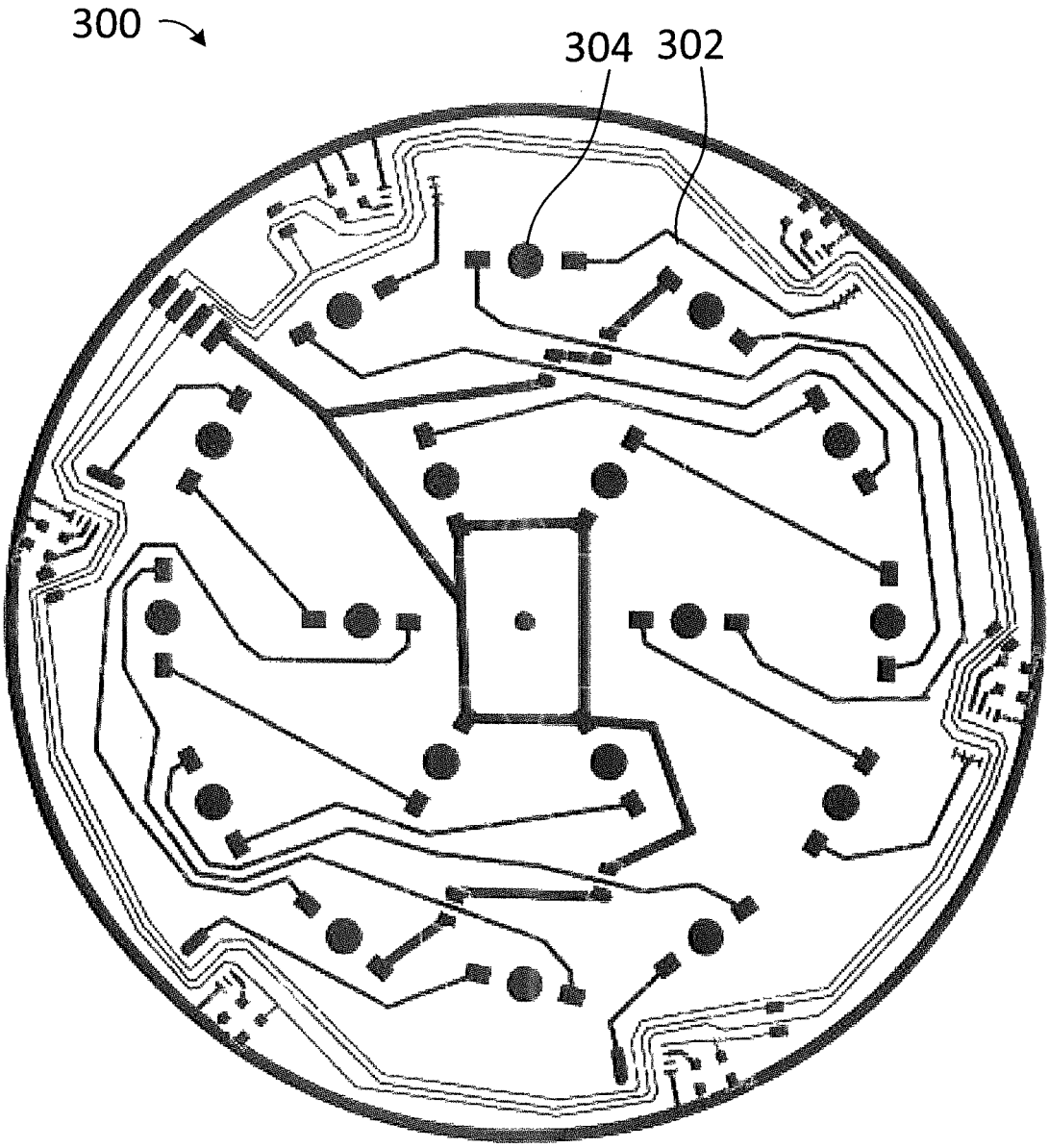
FIG. 11 is a circuit diagram of an underwater light assembly, in accordance with a further embodiment.

FIG. 11 illustrates a circuit diagram 300 for a back plate (e.g., light plate 112 of FIG. 5), in accordance with an embodiment. The light may include an AC12V input and having a power of 54 W. The circuitry 302 may connect 18 LED lights 304, having RGB colors and 3 W.

While the above description provides examples of one or more apparatus, methods, or systems, it will be appreciated that other apparatus, methods, or systems may be within the scope of the claims as interpreted by one of skill in the art.

The invention claimed is:

1. An underwater lighting assembly comprising:

a mounting plate for attaching to an underwater surface of a container for holding a body of water, the mounting plate including a housing slot located at a lower portion of the mounting plate;

at least one light source for providing light;

a controller electrically connected to the at least one light source, the controller being configured to control the at least one light source;

a housing for providing a watertight seal to enclose the at least one light source and the controller, the housing being attachable to the mounting plate, the housing having a mounting tab extending from a rear surface shaped to fit within the housing slot, the housing having an aperture extending through a top portion thereof, the aperture being shaped to allow a fastener to extend there through and be fastened to an upper portion of the mounting plate; and a signal wire for receiving remote control signals, the signal wire being electrically connected to the controller and configured to extend from the controller to an area outside of the body of water.

2. The underwater lighting assembly of claim 1 further comprising a light plate for supporting the light source, wherein the light source is spaced from the light plate.

3. The underwater lighting assembly of claim 2 further comprising a controller board mounted to the housing, wherein the controller is mounted to the controller board.

4. The underwater lighting assembly of claim 3 further comprising an encapsulating layer for encapsulation light plate and the controller board, wherein the encapsulating layer does not encapsulate the at least one light source.

5. The underwater lighting assembly of claim 4, wherein the light plate is spaced apart by a distance D from the controller board, wherein the distance D is selected to provide heat dissipation through the encapsulating layer between the light plate and the controller board.

6. The underwater lighting assembly of claim 5, wherein the distance D is between 0.25 and 0.75 inches.

7. The underwater lighting assembly of claim 1, wherein the at least one light source is a plurality of light emitting diodes (LEDs), and wherein each of the LEDs includes a lens that disperses the light thorough a selected angle of dispersion.

8. The underwater lighting assembly of claim 7, wherein the LEDs are low power and low voltage.

9. The underwater lighting assembly of claim 7, wherein the LEDs are any one or more of blue, red, or green LEDs.

10. The underwater lighting assembly of claim 1 further comprising an adapter ring for mounting between the mounting plate and the underwater surface, the adapter ring being a retrofit adapter ring having apertures spaced and shaped to allow the adapter ring to be mounted to existing light fixtures.

11. The underwater lighting assembly of claim 1, wherein the mounting plate is a universal mounting plate having a plurality of sets of mounting holes, the sets of mounting holes being positioned to register with pre-existing sets of mounting holes in the underwater surface.

12. The underwater lighting assembly of claim 1, wherein the housing includes a front lens, wherein the front lens includes retracting prisms that facilitate light retention within the body of water.

13. A system for underwater lighting, the system comprising:

an underwater lighting assembly comprising:

a mounting plate for attaching to an underwater surface of a container for holding a body of water;

at least one light source for providing light;

a controller electrically connected to the at least one light source, the controller being configured to control the at least one light source;

a housing for providing a watertight seal to enclose the at least one light source and the controller, the housing being attachable to the mounting plate; and a signal wire for receiving remote control signals, the signal wire being electrically connected to the controller and configured to extend from the controller to an area outside of the body of water, wherein the signal wire is configured to pass through a rear surface of the housing and through a conduit in the container that extends to the area outside the body of water;

a signal receiver connected to the signal wire in the area outside the body of water; and a remote control for remotely controlling the controller by sending signals to the signal receiver.

14. The system of claim 13 further comprising a transformer electrically connected to the underwater light assembly and a power source, wherein the transformer reduces voltage and power provided to the underwater lighting assembly.

15. The system of claim 13, wherein the remote control includes a plurality of buttons for selecting the lighting of the underwater lights.

* * * * *